US007739756B2

(12) United States Patent
St-Hilaire

(10) Patent No.: US 7,739,756 B2
(45) Date of Patent: Jun. 22, 2010

(54) SPA WITH INTEGRATED STEP

(76) Inventor: Amélie St-Hilaire, 8, chemin de la Suisse, Morin-Heights, Québec (CA) J0R 1H0

( * ) Notice: Subject to any disclaimer, the term of this patent is extended or adjusted under 35 U.S.C. 154(b) by 980 days.

(21) Appl. No.: 11/505,203

(22) Filed: Aug. 16, 2006

(65) Prior Publication Data

US 2008/0040848 A1 Feb. 21, 2008

(51) Int. Cl.
*A47K 3/00* (2006.01)

(52) U.S. Cl. ..... 4/541.1; 4/506

(58) Field of Classification Search ..... 4/541.1, 4/506, 496; 52/27, 82; 312/235.1, 278; 182/35, 182/88

See application file for complete search history.

(56) References Cited

U.S. PATENT DOCUMENTS 3,789,436 A * 2/1974 Maier-Gerber ..... 4/446
4,545,628 A * 10/1985 Richey ..... 312/235.1
5,235,708 A * 8/1993 Hart ..... 4/496
5,718,007 A * 2/1998 Loyd ..... 4/541.1
5,749,106 A * 5/1998 Loyd et al. ..... 4/541.1
5,755,498 A * 5/1998 Cutler ..... 312/235.1
6,425,457 B1 * 7/2002 Lundry ..... 312/235.1
6,550,084 B2 * 4/2003 Siepmann et al. ..... 5/507.1
6,655,706 B1 * 12/2003 Murrell ..... 182/88
6,802,087 B1 * 10/2004 Podue et al. ..... 4/541.1
2004/0078886 A1 * 4/2004 Hutchings ..... 4/541.1

* cited by examiner

*Primary Examiner*—Khoa D Huynh
(74) *Attorney, Agent, or Firm*—Eric Fincham

(57) ABSTRACT

A spa having an integrated step is shown; the spa comprises a base, a wall extending upwardly from the base to define an enclosure, a recess and a bottom portion of the exterior wall and a sliding step mounted in the recess, the step being moveable between a storage position inside the spa and an extended position wherein the step may be used to access the interior of the spa.

2 Claims, 3 Drawing Sheets

SPA WITH INTEGRATED STEP

FIELD OF THE INVENTION

The present invention relates to spas and more particularly, relates to an improvement in a spa structure.

BACKGROUND OF THE INVENTION

Spas are becoming increasingly popular with many people. This has led to a substantial increase in sales of residential type spas. Typically these spas are either rectangular, oval or circular in configuration and are designed to accommodate between 2 to 12 people.

As used herein, a spa is intended to designate a structure designed to receive water and circulate the same. The spa will provide the bench or chair seating molded on the inside of the spa. Spas are also known as hot tubs and/or whirlpools.

Residential spas are frequently incorporated into a deck structure or some other permanent arrangement whereby access may be easily had to the interior of the spa. Lacking such an installation, the residential spa owner must provide some sort of stair arrangement to permit entry into the spa. Typically, a stool or like element may be utilized.

SUMMARY OF THE INVENTION

It is an object of the present invention to provide a spa having an integrated step to permit entry into the spa.

According to one aspect of the present invention, there is provided a spa comprising a base, an exterior wall extending upwardly from the base to thereby define an enclosure, a recess in a bottom portion of the exterior wall, and a sliding step mounted in the recess, the step being moveable between a storage position inside the spa and an extended position wherein the step may be used to access the interior of the spa.

The improved spa of the present invention can have any of the known external configurations which are conventional in spa design. Thus, the general external configuration may be circular, rectangular, oval, etc.

The spa has, in general terms, a base and a wall extending upwardly therefrom, the wall defining the external configuration of the spa. Many different structures may be utilized including those in which the spa is formed of a single molded component which both defines the external wall and an internal portion having seating arrangements molded therein. Alternatively, there may be provided a structural outer wall with a molded interior portion for containing the water.

Interiorly, the spa will usually have a plurality of water and/or air jets to provide a type of massage to the user. Normally, these jets are carefully arranged in conjunction with the seating to provide the desired massage effect. The seating will typically be molded seating and may comprise arrangements suitable for sitting and/or lying in a somewhat prone position.

The present invention incorporates a step which is moveable between a first retracted position wherein it is stored within the spa and a second position where it extends exteriorly of the spa to permit access thereto. Preferably, the step operates in the fashion of a drawer—i.e. it will have one or more portions riding on a ledge or the like to permit sliding movement thereof. Preferably, there may be provided means to prevent the stair from being pulled completely exteriorly of the spa. Naturally, any suitable arrangement can be employed including the use of sliders conventionally employed for drawers and the like.

The step walls will preferably be arranged so as to be integrated with the appearance of the exterior wall of the spa.

The step is preferably located in one of those portions forming the seating of the spa. This permits storage within the interior.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
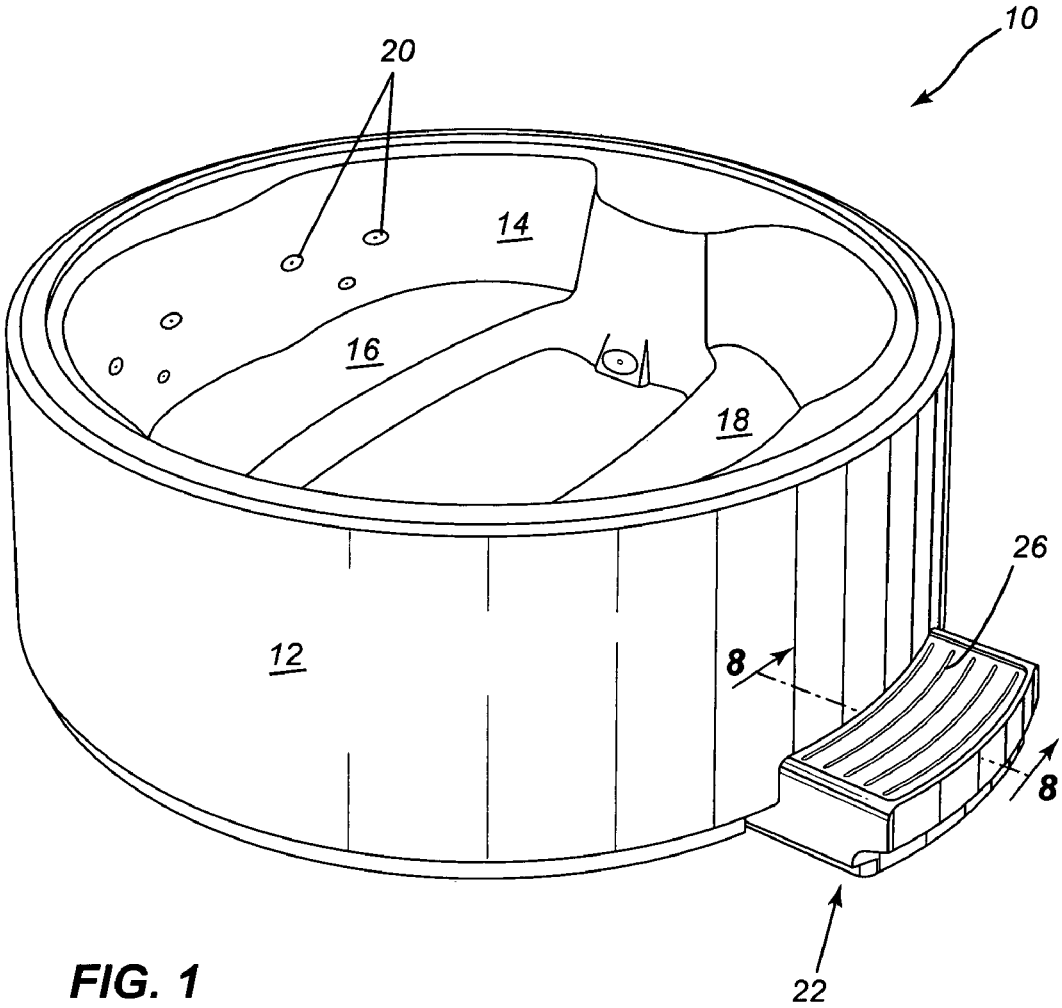
FIG. 1 is a perspective view of a spa having an integrated step in an extended position.
Figure 2:
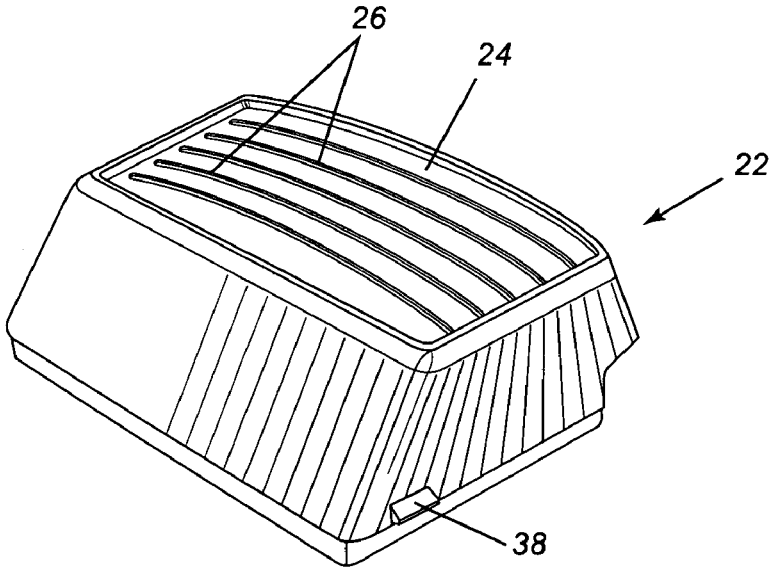
FIG. 2 is a partial sectional thereof.
Figure 3:
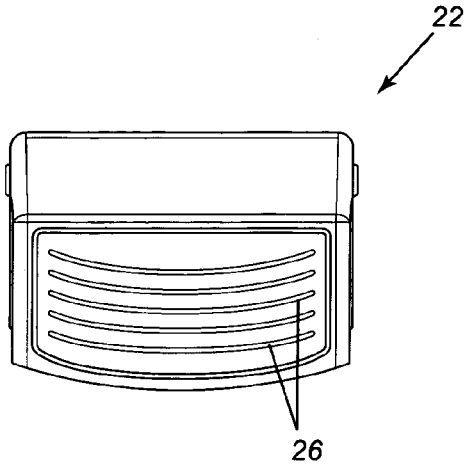
FIG. 3 is a top plan view of the retractable step.
Figure 4:
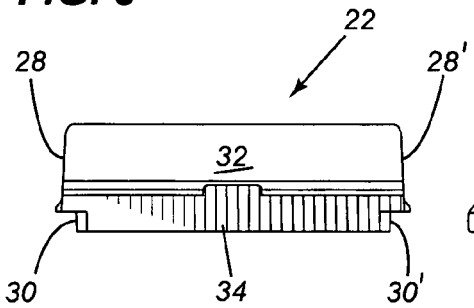
FIG. 4 is a front elevational view thereof.
Figure 5:
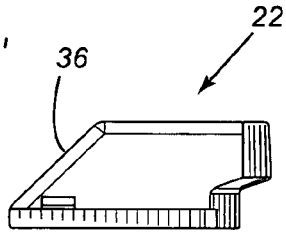
FIG. 5 is a side elevational view thereof.
Figure 6:
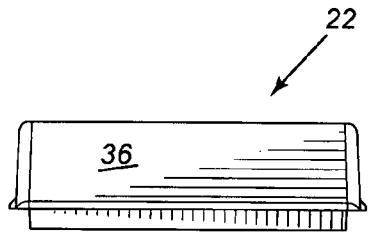
FIG. 6 is a rear elevational view thereof.
Figure 7:
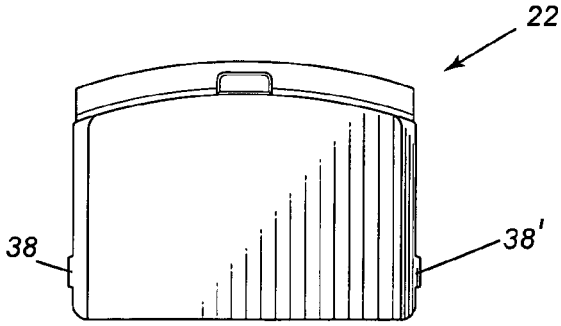
FIG. 7 is a bottom plan view thereof.
Figure 8:
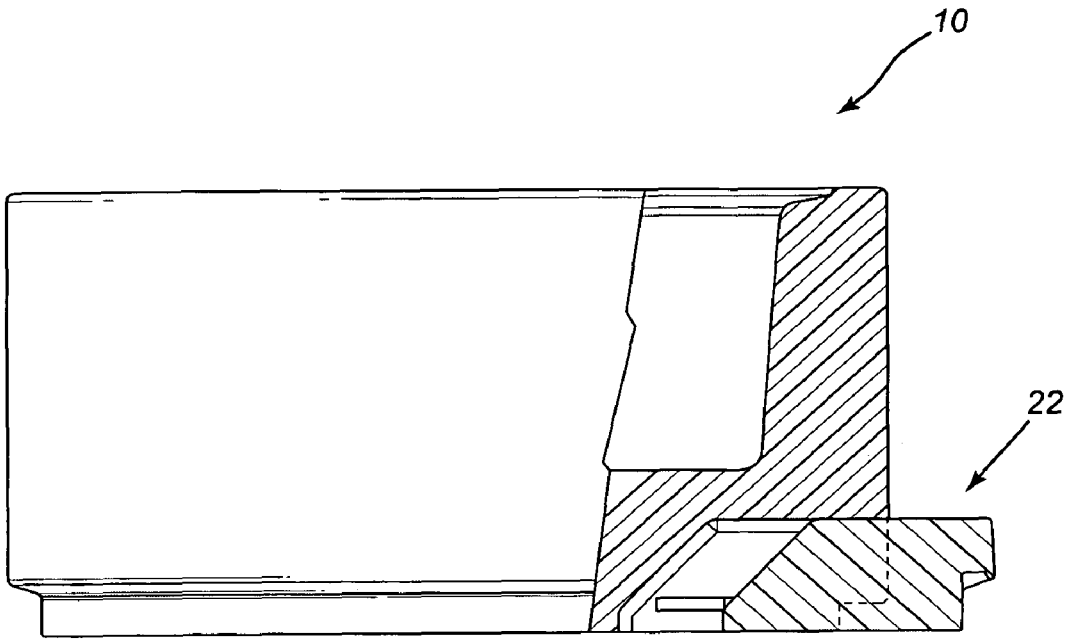
FIG. 8 is a partial sectional view thereof.
Figure 9:
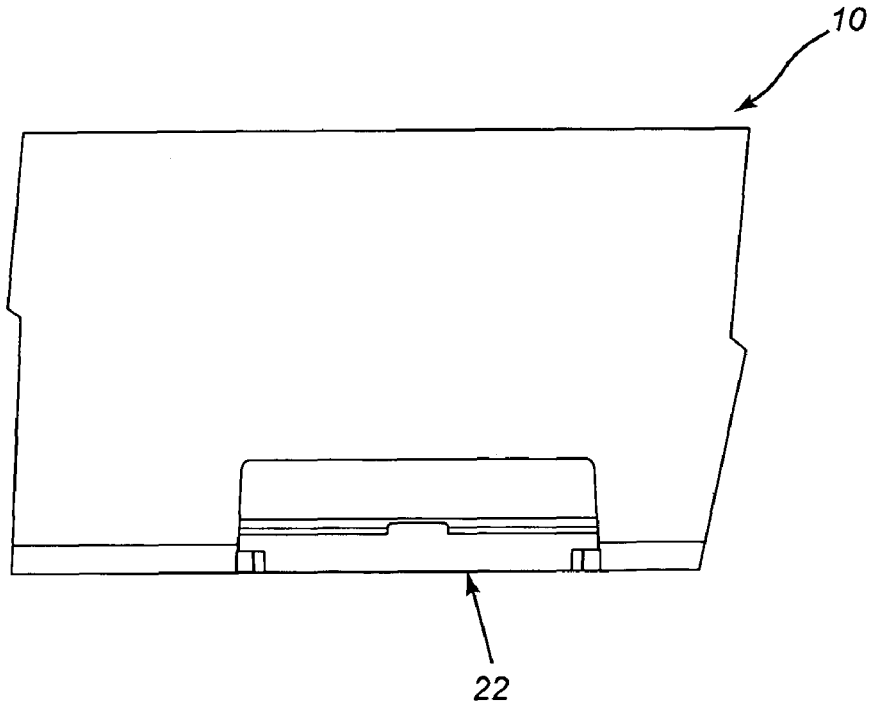
FIG. 9 is a front elevational view of a portion of the spa with the step.

Referring to the drawings in greater detail and by reference characters thereto, there is illustrated a typical spa which is generally designated by reference numeral 10.

Spa 10 has an outer wall 12 and a molded inner wall 14. Inner wall 14 is preferably molded as a single unit and in the illustrated embodiment, includes a pair of seats or benches 16 and 18. In this regard, inner wall or shell 14 may be formed of any suitable material though generally, a fibreglass coated with an acrylic material is utilized. Although outer wall 12 is shown as being of a different structure than inner shell 14, a single unit could be utilized.

Within shell 14, there is provided a plurality of water jets 20 as is conventional and well known in the art. Air jets may also be provided.

A retractable step 22 is illustrated and is designed to fit within a cavity 23 formed under seat 16.

Retractable step 22 includes an upper surface 24 which may have ribs 26 thereon to provide a slip resistant surface. Retractable step 22 also includes upper side walls 28, 28' and lower side walls 30, 30'. This arrangement provides for a recess at the lower portion thereof. Similarly, storable step 22 includes an upper front wall 32 and a lower front wall 34 which is recessed inwardly. A sloping rear wall 36 is also provided.

As will be noted, on upper walls 28, 28' there are provided lugs 38, 38' which are designed to seat on a surface of the wall structure defining cavity 23. With this arrangement, a separate step for entry into spa 10 is not required.

It will be understood that the above described embodiment is for purposes of illustration only and that changes and modifications may be made thereto without departing from the spirit and scope of the invention.

I claim:

1. A spa comprising:

a generally circular base mounted on a floor;

a generally circular inner wall defining an interior portion of said spa for holding water, said inner wall having a plurality of seats integrally molded therein, said inner wall also includes a plurality of water and air jets arranged in conjunction with said seats to provide a desired massage effect, wherein said plurality of water and air jets are connected to a conventional water and air circulation system of the spa;

a generally circular outer wall extending upwardly from said base to thereby define a generally circular enclosure having a top rim and a bottom portion, wherein said enclosure surrounds said inner wall and said interior portion of the spa, wherein said enclosure defines the external configuration of the spa;

a cavity formed in said bottom portion of said circular outer wall adjacent said floor, said cavity located directly underneath one of said plurality of seats, said cavity having a sloping back wall and side walls, each of said side walls including a support rail; and a retractable step disposed within said cavity and adapted to rest on said floor, said step being moveable between a storage position where said step is fitted within said cavity inside the spa and directly underneath said one seat, and an extended position wherein said step extends outside of said cavity so that said step is used for allowing a user to enter said interior portion of the spa, wherein said retractable step has an upper surface for being used as a stepping surface when said step is in said extended position, upper side walls, lower side walls, an upper front wall, a sloping rear wall for mating with said sloping back wall of said cavity, and a lower front wall that is recessed inwardly; wherein each of said upper side walls has a sliding lug extending outwardly thereof, said sliding lugs being designed to ride on said support rails for allowing said retractable step to slide back and forth between said storage position and said extended position, wherein the spa has an overall circular configuration, and wherein said upper front wall of said retractable step is arcuate in configuration to conform to said circular outer wall.

2. The spa of claim 1, wherein said upper surface of said step is a non-slip upper surface.

* * * * *